US006140886A

United States Patent [19]

Fratti et al.

[11] Patent Number: 6,140,886

[45] Date of Patent: Oct. 31, 2000

[54] WIDEBAND BALUN FOR WIRELESS AND RF APPLICATION

[75] Inventors: Roger Anthony Fratti, Shillington; John Wayne Bowen, Warminster, both of Pa.; Melvin West, Willingboro, N.J.

[73] Assignee: Lucent Technologies, Inc., Murray Hill, N.J.

[21] Appl. No.: 09/257,014

[22] Filed: Feb. 25, 1999

[51] Int. Cl.[7] ..... H01P 5/10

[52] U.S. Cl. ..... 333/26; 333/33

[58] Field of Search ..... 333/26, 33; 343/859

[56] References Cited

U.S. PATENT DOCUMENTS

| | | | |
|---|---|---|---|
| 3,991,390 | 11/1976 | Conroy | 333/26 |
| 5,774,801 | 11/1976 | Li et al. | 333/25 X |
| 6,018,277 | 1/2000 | Vaisanen | 333/26 |

OTHER PUBLICATIONS

IEEE Transactions on Parts, Hybrids, and Packaging, "Wiggly Phase Shifters and Directional Couplers for Radio–Frequency Hybrid–Microcircuit Applications", Dec., 1976, pp. 317–323.

Microwave Journal, "Optimization of TEM Mode Tapered Symmetrical Couplers", S. Seward et al, Dec., 1985, pp. 113–119.

*Primary Examiner*—Justin P. Bettendorf

[57] ABSTRACT

A transmission line balun transformer for providing a single ended output signal from a pair of differential input signals includes two transmission line signal couplers. The couplers are individually designed to be relatively loosely coupled devices, i.e. having a coupling factor greater than 3 dB, but are coupled together with proper phase relationships so as to achieve a relatively tighter composite coupling characteristic in the order of 3 dB, thereby resulting in an increase in bandwidth.

25 Claims, 5 Drawing Sheets

WIDEBAND BALUN FOR WIRELESS AND RF APPLICATION

BACKGROUND OF THE INVENTION

1. Field of the Invention

The present invention is directed to a balun transformer for providing a single ended output signal from a pair of differential input signals, and more particularly to a transmission line balun implemented by a pair of inter-coupled transmission line signal couplers.

2. Description of the Related Art

As is well known, RF wireless circuits utilize balanced outputs of signals to minimize the effect of ground inductance and to improve common mode rejection. Such circuitry include mixers, modulators, IF strips and voltage controlled oscillators. These balanced outputs, moreover, consist of differential signals which must be combined to provide a single ended output signal. One known type of device for combining differential signals into a single ended output signal is referred to in the art as a "balun" (balanced input/unbalanced output). Typically, baluns are tightly coupled structures fabricated much like a conventional transformer utilizing discrete components; however, the turns are arranged physically to include the interwinding capacitances as components of the characteristic impedance of a transmission line. Such a technique can result in increasing the bandwidth of the device up into the megahertz frequency range. More Recently, baluns have been implemented using distributed components. When implemented with discrete components, they add excessive loss and increase the cost of fabrication. When implemented in distributed form they exhibit less loss, but at wireless frequencies require a relatively large amount of board space together with an inherent limitation of being narrow band devices.

SUMMARY OF THE INVENTION

The present invention is directed to an improvement in apparatus for implementing a transmission line balun transformer for providing a single ended output signal from a pair of differential input signals. This is achieved by cross coupling the components of a pair of transmission line signal couplers in tandem. At least one of the couplers is designed to be a relatively loosely coupled device, typically having a coupling characteristic, i.e., coupling factor greater than 3 dB. When desirable, both couplers can have the same or unequal coupling factor. However, the two couplers are coupled together with proper phase relationships so as to achieve a relatively tighter resulting coupling characteristic, preferably about 3 dB, thereby resulting in an increase in bandwidth. Although not limited to such, in a preferred embodiment, each coupler comprises a microstrip transmission line coupler including pairs of mutually adjacent microstrip transmission line elements formed on opposite sides of a dielectric support member, such as a circuit board, and also including an intermediate ground plane for mutually isolating the couplers. The couplers are internally coupled together through apertures in the ground plane, with the pair of input signal ports and an output port being located on one outer edge surface of the printed circuit board. The transmission line elements can be elongated microstrips of constant width, in the form of a sawtooth or wiggly elements, and can be tapered either in width or separation. Also, the coupler can be fabricated as a stripline device.

DETAILED DESCRIPTION OF THE INVENTION

Figure 1:
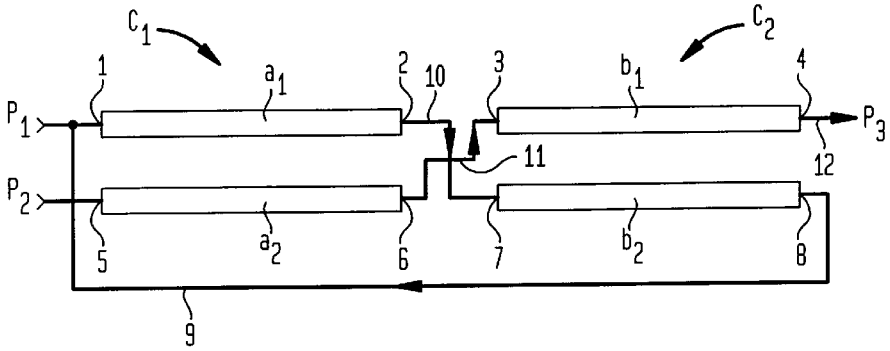
FIG. 1 is an electrical schematic diagram illustrative of a first embodiment of the invention.

Referring now to the drawing figures and more particularly to FIG. 1, shown thereat is an electrical schematic diagram of a first embodiment of the invention which comprises two relatively loosely coupled transmission line couplers $C_1$ and $C_2$. The couplers are implemented by pairs of mutually parallel microstrip transmission line elements $a_1$, $a_2$, and $b_1$, $b_2$ of substantially equal length. The input ends of these elements are designated by reference numerals 1, 3, 5 and 7, while the output ends thereof are designated by reference numerals 2, 4, 6, and 8, as shown.

The coupler $C_1$ in FIG. 1 is connected to a pair of input ports $P_1$ and $P_2$, which are respectively coupled to the input ends 1 and 5 of microwave transmission line elements $a_1$ and $a_2$. The output ends 2 and 6 of elements $a_1$ and $a_2$ are respectively cross-coupled in tandem to input ends 7 and 3 of transmission line elements $b_1$ and $b_2$ by means of electrical connections 10 and 11. The output end 8 of coupler element $b_2$ of $C_2$ is connected back to the input end 1 of coupler element $a_1$ of $C_1$ by means of an electrical connection 9. The output end 4 of coupler element $b_1$ is connected to a single output port $P_3$ by means of electrical connection 12. The cross-coupling and feedback provided by connections 9, 10 and 11 operate to properly phase the two couplers $C_1$ and $C_2$ so as to provide an overall or resultant coupling characteristic, i.e. coupling factor which is tighter than the respective coupling factor provided by the individual couplers per se. While the overall coupling factor is at least greater than 3 dB, it preferably is about 3 dB. At least one of couplings C1 and C2 provides a coupling factor which is greater than 3 dB; however, the coupling factors of the two couplers need not necessarily be the same, but can be when desired.

Figure 2:
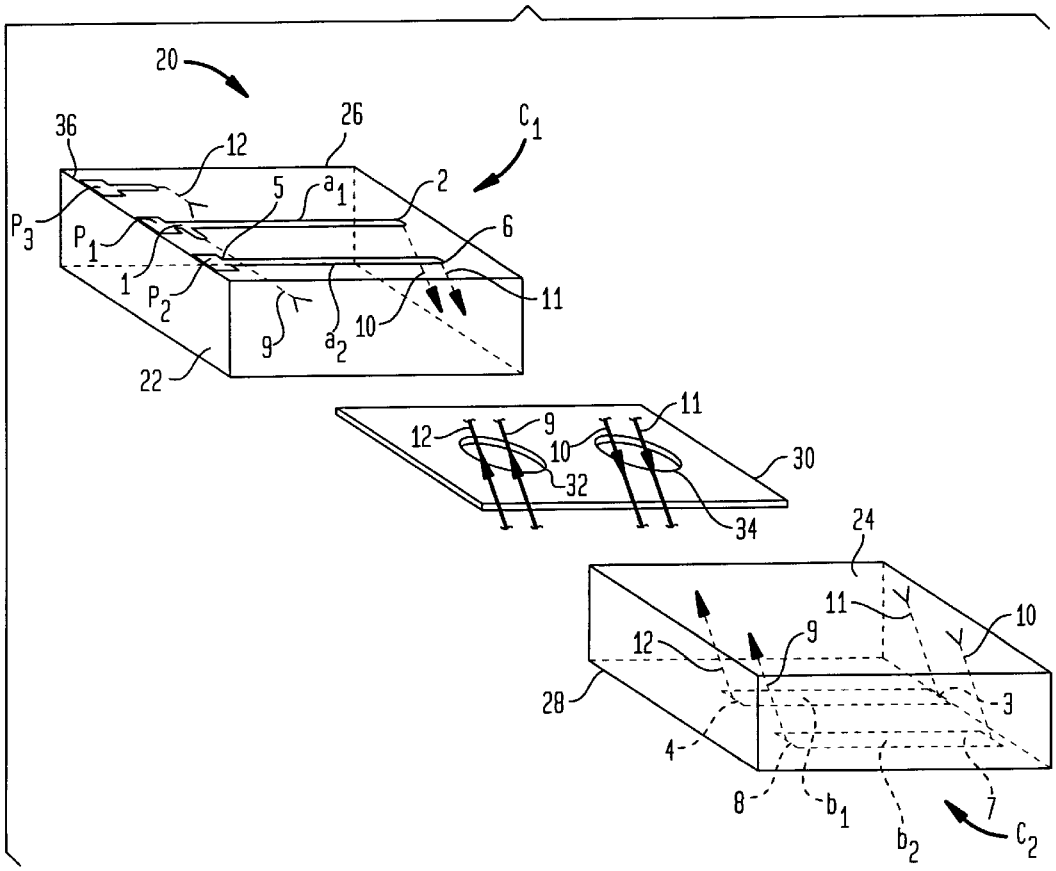
FIG. 2 is an exploded perspective view illustrative of a microstrip implementation of the embodiment shown in FIG. 1.
Figure 3:
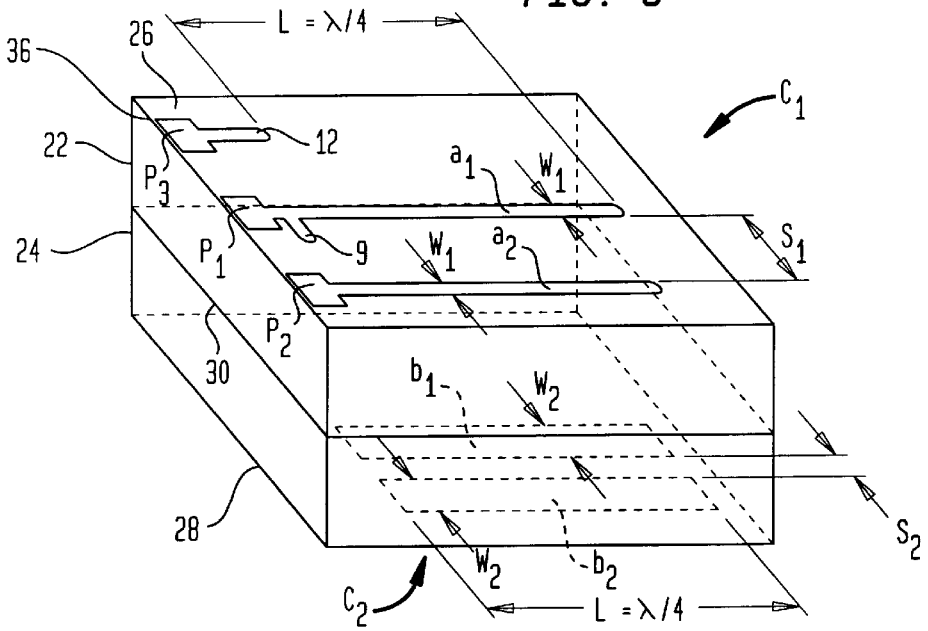
FIG. 3 is a perspective view of a composite of the microstrip implementation shown in FIG. 2.

The configuration shown schematically in FIG. 1 is physically implemented on opposite sides of a support member such as a circuit board comprised of dielectric material. As shown in FIGS. 2 and 3, a circuit board member 20 of a generally rectangular shape is comprised of upper and lower half sections 22 and 24, having respective outer faces 26 and 28. Between the two circuit board half sections 22 and 24 is a layer of metallization 30, which operates as a ground plane to mutually isolate the two couplers $C_1$ and $C_2$ formed on the outer surfaces 26 and 28. As shown in FIG. 2, the layer of metallization 30 includes at least one, but preferably two, apertures or openings 32 and 34 for interconnecting the couplers $C_1$ and $C_2$.

As shown in FIGS. 2 and 3, the two input ports $P_1$ and $P_2$ as well as the output port $P_3$ are located along a common edge 36 of the outer face 26 of the upper half section 22 of the printed circuit board member 20. It should be noted that the upper pair of microstrip transmission line elements $a_1$ and $a_2$ extend outwardly away from the input ports $P_1$ and $P_2$. As noted above, they consist of elongated elements having, for example, an electrical length L of, preferably but not limited to, about $\lambda/4$, with a constant width of $W_1$ and a mutual separation of $S_1$. In like fashion, the lower pair of microstrip transmission line elements $b_1$ and $b_2$ of coupler $C_2$ are also comprised of elongated strips of microstrip, being of equal electrical length, about $L=\lambda/4$, and having a constant width $W_2$ and a mutual separation $S_2$ as shown in FIG. 3. The physical dimensions of $a_1$, $a_2$; $b_1$, $b_2$; $W_1$, $W_2$; and $S_1$, $S_2$ are application specific and thus may be equal or unequal depending on the required design.

Figure 4:
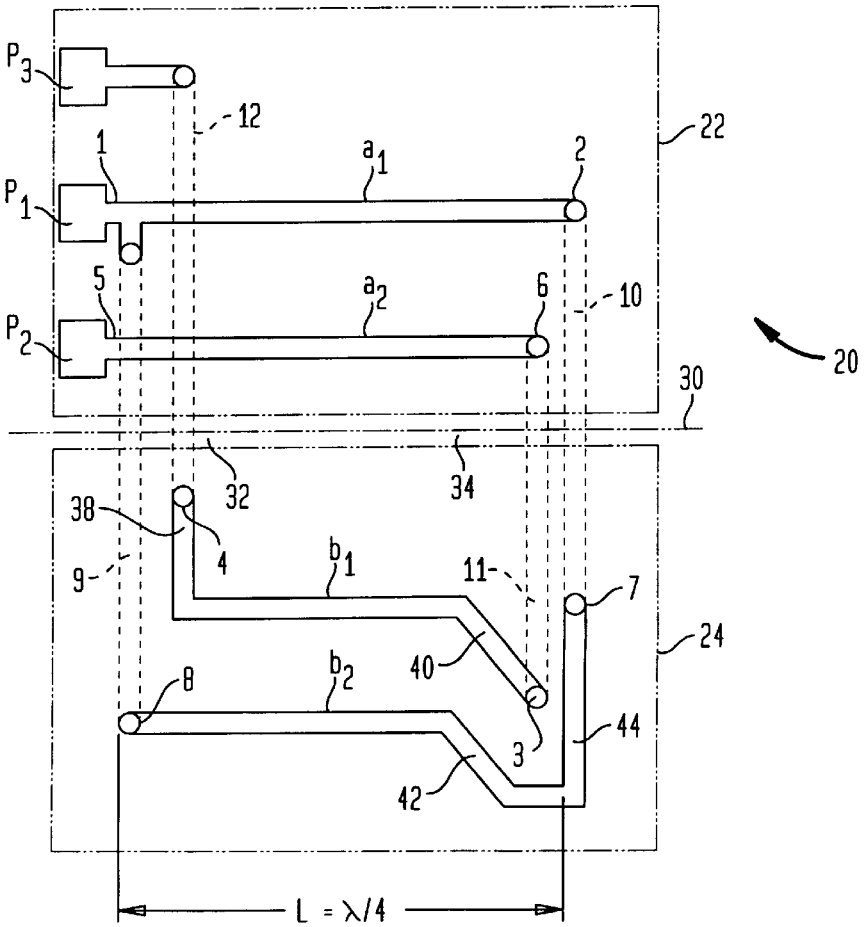
FIG. 4 is a diagram helpful in understanding the internal connection between the elements of the embodiment of the invention shown in FIGS. 2 and 3.

The electrical connections 9, 10, 11 and 12 shown in FIG. 1, are physically implemented by electrical vias formed in the circuit board sections 22 and 24 in a well known manner. While the vias are shown schematically in FIG. 2, a physical implementation by which the vias 9, 10, 11 and 12 can be formed by vertical columns of metallization are shown in FIG. 4. Achieving this result, the bottom microstrip transmission elements $b_1$ and $b_2$ are configured to include a right angled elbow portion 38 and a generally angulated portion 40 in $b_1$ and $b_2$ includes a downwardly angulated portion 42 and to a right angled elbow section 44 which terminates at end 7. This type of configuration is easily attained; however, other types of designs may be resorted to when desired.

Figure 5:
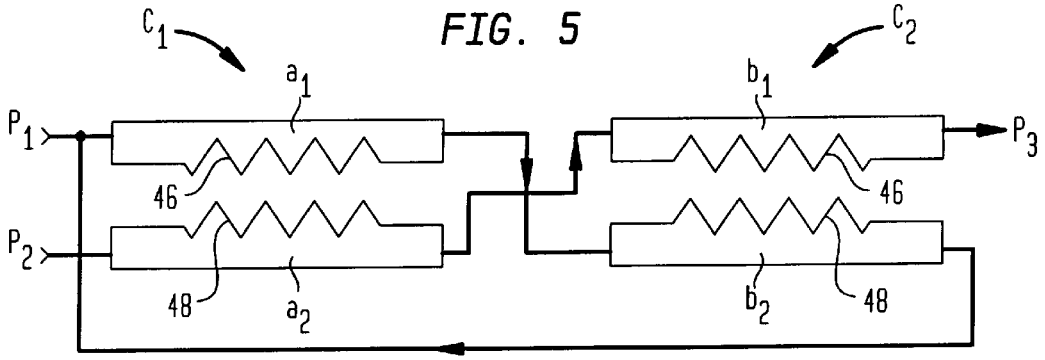
FIG. 5 is an electrical schematic diagram illustrative of a second embodiment of the invention.

Referring now to FIGS. 5–8, shown therein are four additional embodiments of the invention. With respect to FIG. 5, shown thereat is an electrical schematic similar to FIG. 1, but where the couplers $C_1$ and $C_2$ comprise what is referred to in the art as "wiggly" couplers where the transmission line elements $a_1$, $a_2$ and $b_1$, $b_2$ include opposing serrated or saw-tooth inner edges 46 and 48, respectively. Again, the elements have an electrical length, preferably, but not necessarily limited to $\lambda/4$. The interconnections remain the same as shown in FIG. 1.

The concept of wiggly couplers is disclosed in further detail in a publication entitled "Wiggly Phase Shifters And Directional Couplers For Radio-Frequency Hybrid-Microcircuit Applications", J. Taylor et al., *IEEE Transactions On Parts, Hybrids In Packaging*, Vol. PHP-12, No. 4, December, 1976, pp. 317–323.

Figure 6:
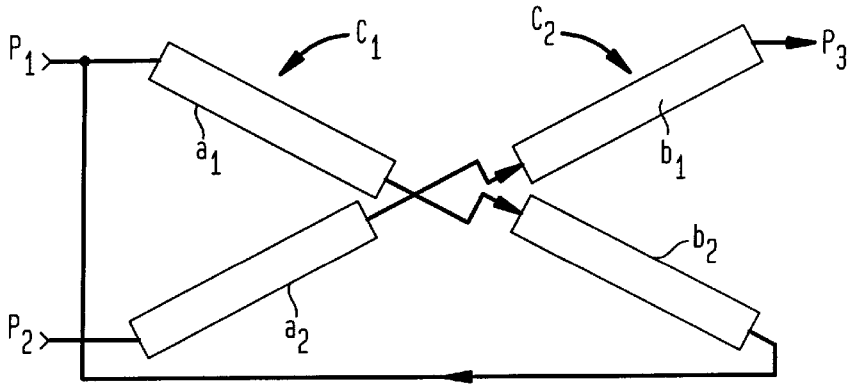
FIG. 6 is an electrical schematic diagram illustrative of a third embodiment of the invention.
Figure 7:
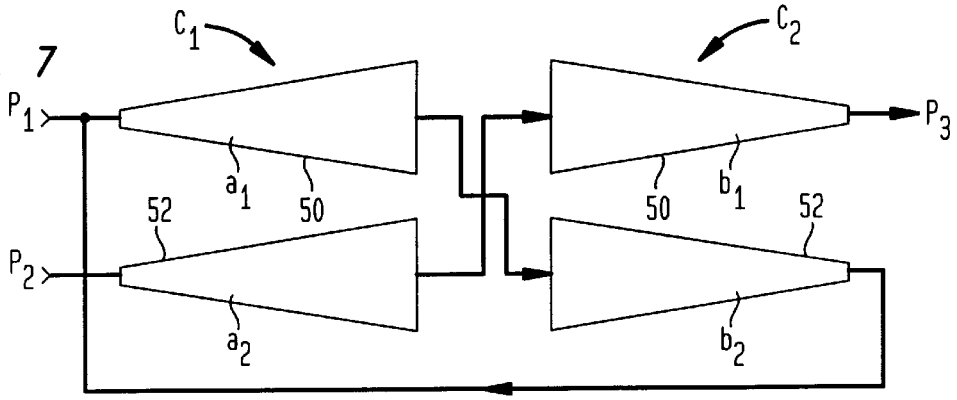
FIG. 7 is an electrical schematic diagram illustrative of a fourth embodiment of the invention.

The embodiments shown in FIGS. 6 and 7 disclose two variations of what is known as "tapered" couplers. In FIG. 6, the transition line elements $a_1$, $a_2$ and $b_1$ and $b_2$ comprise elongated elements having a generally constant width, but whose mutual separation describes a taper. The embodiment shown in FIG. 7, however, discloses a configuration where the transmission elements $a_1$, $a_2$ and $b_1$, $b_2$ comprise elements themselves which are tapered in width. In both instances, the electrical connections of the elements are the same as shown in FIG. 1.

For a more detailed treatment of this type of coupler, one is directed to a publication entitled "Optimization Of TEM Mode Tapered Symmetrical Couplers", S. Seward et al., *Microwave Journal*, December, 1985, pp. 113–119.

Figure 8:
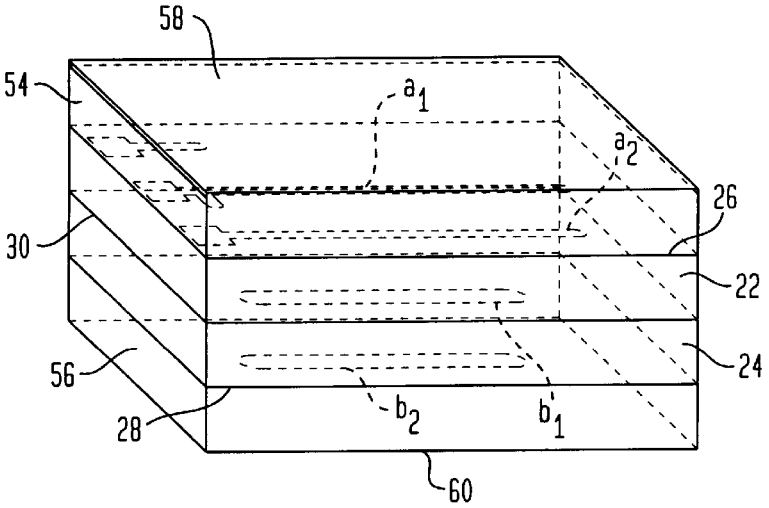
FIG. 8 is a perspective view of a stripline implementation of the embodiment shown in FIG. 1.

With respect to FIG. 8, shown thereat is a stripline implementation of the invention shown in FIGS. 2 and 3. As before, the stripline embodiment of FIG. 8 includes a pair of circuit board sections 22 and 24 being separated by a ground plane 30, with the transmission line elements $a_1$ and $a_2$ being formed on the top portion of circuit board section 22 and the transmission line elements $b_1$ and $b_2$ being formed on the outer portion of the lower circuit board section 24. Now, however, a pair of outer dielectric members 54 and 56 having substantially the same shape as the circuit board sections 22 and 24, are formed over the outer surfaces 26 and 28. Additionally, the dielectric members 54 and 56 also include outer surfaces of metallization 58 and 60 as shown. Such a configuration can readily be fabricated using conventional techniques.

Figure 9:
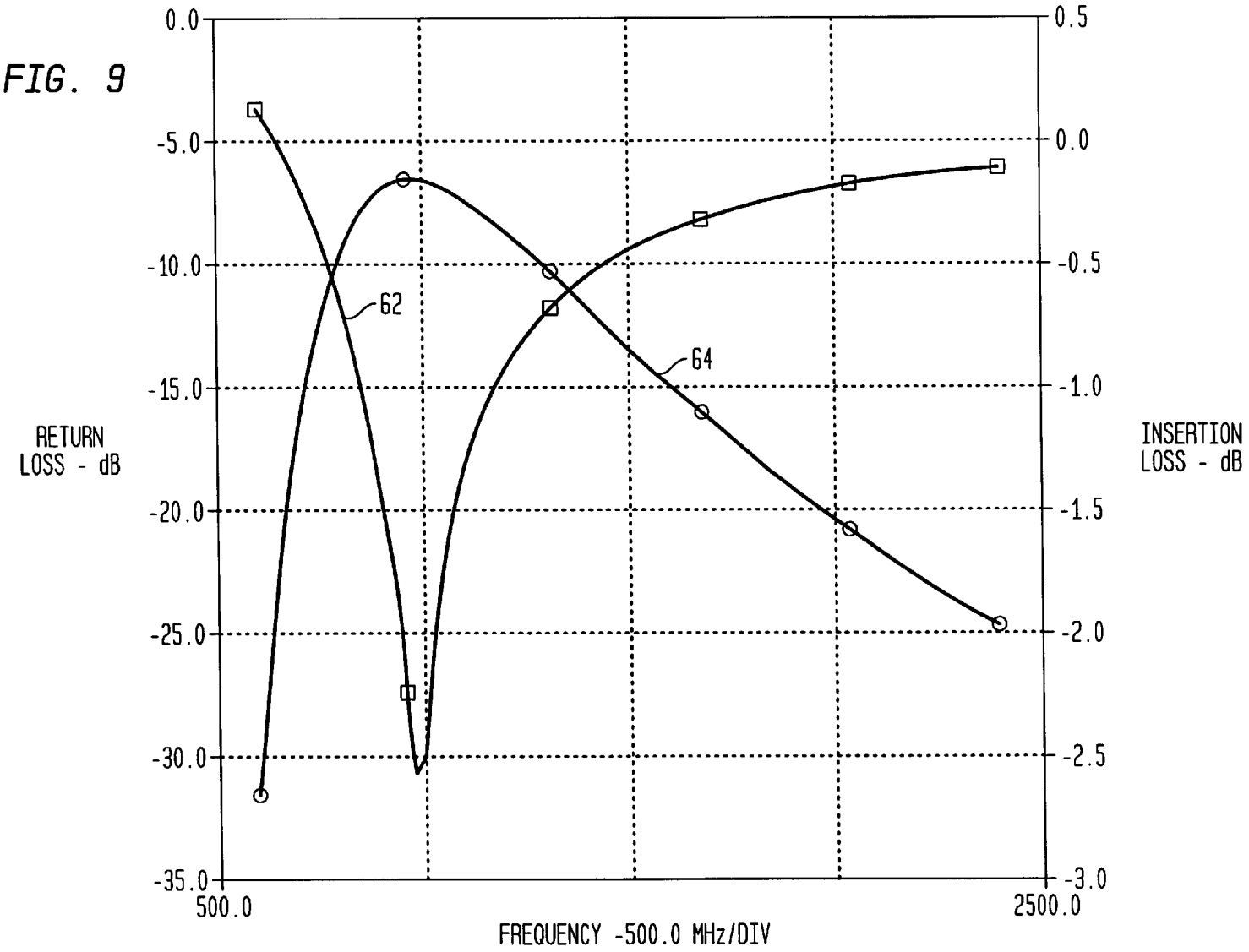
FIG. 9 is a set of characteristic curves illustrative of the frequency response of a single coupler section of the balun illustrated in FIGS. 1–4.
Figure 10:
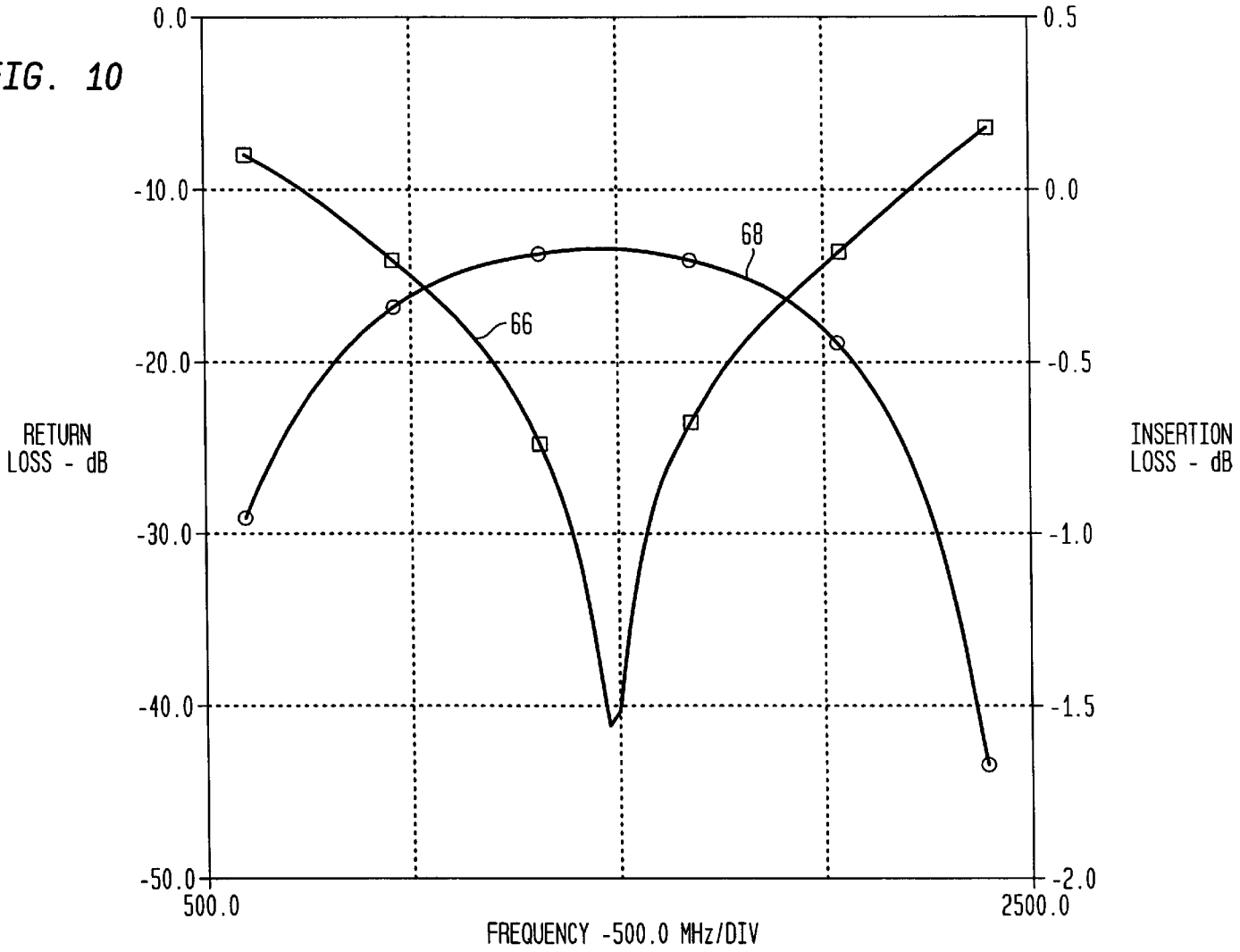
FIG. 10 is a set of characteristic curves illustrative of the frequency response of the two coupler sections connected in tandem of the balun illustrated in FIGS. 1–4.

Referring now to FIGS. 9 and 10, FIG. 5 depicts the frequency response of a 8.34 dB edge-coupled microstrip coupler configured as a balun, while FIG. 6 is illustrative of the frequency response of two 8.34 dB couplers configured in a tandem configuration as shown in FIGS. 1–4. In FIG. 5, reference numeral 62 denotes the return loss while reference numeral 64 denotes the insertion loss of each of the two couplers $C_1$ and $C_2$. As shown, the return loss 62 peaks at around 1000 MHz. The minimum insertion loss occurs at the same frequency, but falls off sharply on either side of about −0.2 dB. On the other hand, the composite return loss, as indicated by reference numeral 66 in FIG. 6, dips to about −40 dB at around 1500 MHz. The composite insertion loss, as indicated by curve 68 of FIG. 6, is indicative of a change of only about 0.25 dB over a bandwidth of almost 1000 MHz, thus illustrating the broadband result achieved by the subject invention.

Thus it can be seen that by properly phasing the signals in, for example, two tandemly coupled 8.34 dB couplers, a tighter overall coupling of 3 dB can be achieved and the bandwidth be extended. Also by using both sides of a dielectric circuit board member, the coupler configuration as shown in FIGS. 2 and 3 fits into the same space as a single coupler and actually becomes more accommodating in terms of board layout since both the balanced inputs and single ended outputs are fabricated on the same edge.

The foregoing detailed description is merely illustrative of the principles of the invention. It will thus be appreciated that those skilled in the art will be able to devise various arrangements which, although not explicitly described or shown herein, embody the principles of the invention and are thus within its spirit and scope.

What is claimed is:

1. A transmission line balun transformer for providing a single ended output signal from a pair of differential input signals, comprising:

a first and a second transmission line signal coupler having a respective coupling characteristic, said couplers being electromagnetically isolated from each other and including transmission line elements tandemly cross-coupled together and having a feedback connection therebetween so as to provide predetermined signal phasing, whereby an improved overall coupling characteristic relative to the respective coupling characteristic of said first and second signal coupler is obtained.

2. A balun transformer as defined in claim 1 wherein the coupling characteristic of both couplers are substantially the same.

3. A balun transformer as defined in claim 1 wherein the coupling characteristic of both couplers are mutually different.

4. A balun transformer as defined in claim 1 wherein the coupling characteristic of at least one of said couplers is greater than 3 dB.

5. A balun transformer as defined in claim 1 wherein the coupling characteristic of at least one of the first and second couplers is greater than 3 dB, and the overall coupling characteristic is about equal to or greater than 3 dB.

6. A balun transformer as defined in claim 1 wherein said first and second pairs of transmission line elements have predetermined physical dimensions and separations specific to an intended application.

7. A balun transformer as defined in claim 6 wherein said pairs of transmission line elements are comprised of discrete lengths of conductor material.

8. A balun transformer as defined in claim 7 wherein said lengths of conductor material are mutually angulated so as to provide a tapered separation therebetween.

9. A balun transformer as defined in claim 7 wherein said lengths of conductor material are located mutually parallel with one another.

10. A balun transformer as defined in claim 1 wherein each of said couplers includes pairs of transmission line elements having respective input ends and output ends and wherein the output ends of the first signal coupler are cross-coupled to the input ends of the second signal coupler and one output end of the second signal coupler is connected back to one input end of the first signal coupler.

11. A balun transformer as defined in claim 10 wherein said pairs of transmission line elements are comprised of discrete lengths of conductor material having a tapered width dimension from one end to another.

12. A balun transformer as defined in claim 10 wherein said pairs of transmission line elements are comprised of discrete lengths of conductor material having mutually opposing serrated edges.

13. A balun transformer as defined in claim 1 wherein said pairs of transmission line elements comprise transmission line elements having a length of about a quarter wavelength.

14. A transmission line balun transformer for providing a single ended output signal from a pair of differential input signals, comprising:

a first and a second transmission line signal coupler having a respective coupling characteristic, said couplers being electromagnetically isolated from each other and including transmission line elements tandemly connected together with a predetermined signal phasing so as to provide an improved overall coupling characteristic relative to the respective coupling characteristic of said first and second signal coupler, wherein said pairs of transmission line elements are respectively located on opposing side regions of a dielectric support member, and wherein said dielectric support member comprises a circuit board member including an intermediate layer of electrically conductive material for isolating the pairs of transmission line elements.

15. A balun transformer as defined in claim 14 wherein said pairs of transmission line elements comprise pairs of parallel transmission line elements respectively located on an outer surface of said opposing side regions of said circuit board member.

16. A balun transformer as defined by claim 14 wherein said intermediate layer of electrically conductive material includes at least one opening therein so as to facilitate electrical connections between said pairs of transmission line elements.

17. A balun transformer as defined in claim 16 and additionally including vias in said circuit board member and passing through said at least one opening in said intermediate layer of conductive material for cross connecting said ends of said transmission line elements and for connecting said one output end of the second signal coupler to said one input end of the first signal coupler.

18. A balun transformer as defined in claim 14 and additionally including a pair of input ports and a single output port commonly located along a common edge of said circuit board member for coupling signals to and from the balun transformer.

19. A balun transformer as defined in claim 14 wherein at least one of said pair of transmission line elements are located on an outer surface of said circuit board member.

20. A balun transformer as defined in claim 19 wherein said transmission line elements are comprised of microstrip conductors.

21. A balun transformer as defined in claim 14 wherein both said pairs of transmission line elements are located on respective outer surfaces of said circuit board member.

22. A balun transformer as defined in claim 21 wherein said pairs of transmission line elements are comprised of stripline conductors.

23. A balun transformer as defined in claim 14 and additionally including a pair of dielectric members respectively located on opposite faces of said dielectric support common to said opposing side regions and respective layers of electrically conductive material on an outer surface of said pair of dielectric members.

24. A wideband transmission line balun for wireless and RF applications comprising:

a first and a second quarter wavelength stripline transmission line signal coupler having a respective predetermined coupling characteristic and pairs of stripline transmission line elements located on opposite sides of a dielectric circuit board member, said pairs of stripline transmission line elements being electromagnetically isolated from each other by a grouund plane located in the circuit board member, and respective dielectric members having an outer layer of metallization located over the pairs of stripline transmission line elements;

wherein each pair of stripline transmission line elements include respective first and second inputs ends and first and second output ends; and wherein the first and second input ends are connected to a pair of input ports on one edge of the circuit board member, the first and second output ends of the first signal coupler are cross-coupled to the second and first input ends of the second signal coupler, the first output end of the second signal coupler is connected to an output port located on said edge of the circuit board member, and the second output end of the second signal coupler is connected to the first input end of the first signal coupler;

whereby proper signal phasing for effecting an improved composite coupling characteristic relative to the respective coupling characteristic of said first and second signal coupler is provided.

25. A wideband transmission line balun for wireless and RF applications comprising:

a first and a second quarter wavelength microstrip transmission line signal coupler having a respective predetermined coupling characteristic and pairs of microstrip transmission line elements located on opposite faces of a dielectric circuit board member, said pairs of microstrip transmission line elements being electromagnetically isolated from each other by a ground plane located in the circuit board member;

wherein each pair of microstrip transmission line elements include respective first and second input ends and first and second output ends; and wherein the first and second input ends are connected to a pair of input ports on one edge of the circuit board member, the first and second output ends of the first signal coupler are cross-coupled to the second and first input ends of the second signal coupler, the first output end of the second signal coupler is connected to an output port located on said edge of the circuit board member, and the second output end of the second signal coupler is connected to the first input end of the first signal coupler;

whereby proper signal phasing for effecting an improved composite coupling characteristic relative to the respective coupling characteristic of said first and second signal coupler is provided.

* * * * *